United States Patent [19]

Jacobs et al.

[11] Patent Number: 4,734,617

[45] Date of Patent: Mar. 29, 1988

[54] ELECTROLUMINESCENT DISPLAY AND METHOD OF MAKING SAME

[76] Inventors: Sidney Jacobs, 2607 Mimi Cir., Philadelphia, Pa. 19131; John S. Peluso, 70 Lady Diana Cir., Marlton, N.J. 08053

[21] Appl. No.: 869,436

[22] Filed: Jun. 2, 1986

[51] Int. Cl.[4] ..... H05B 33/10; H05B 33/02

[52] U.S. Cl. ..... 313/506; 313/509; 313/511; 445/24; 427/66

[58] Field of Search ..... 313/498, 505, 506, 509, 313/511, 512; 445/23, 24, 25; 427/66; 428/917

[56] References Cited

U.S. PATENT DOCUMENTS

| | | | |
|---|---|---|---|
| 2,485,607 | 10/1949 | Kasperowicz | 117/33.5 |
| 2,729,583 | 1/1956 | Sadowsky | 154/95 |
| 2,734,013 | 2/1956 | Myers | 154/95 |
| 2,757,112 | 7/1956 | Hoyt | 154/99 |
| 2,945,976 | 7/1960 | Fridrich et al. | 313/108 |
| 3,037,137 | 5/1962 | Motson | 313/511 X |
| 3,177,391 | 4/1965 | Devol et al. | 313/108 |
| 3,212,959 | 10/1965 | Varadi et al. | 161/167 |
| 3,214,622 | 10/1965 | D'Errico et al. | 313/108 |
| 3,226,272 | 12/1965 | Longfellow | 156/67 |
| 3,252,845 | 5/1966 | Schindler et al. | 156/67 |
| 3,253,173 | 5/1966 | Levetan | 313/108 |
| 3,305,745 | 2/1967 | Clock et al. | 313/108 |
| 3,341,915 | 9/1967 | Knochel et al. | 29/25.11 |
| 3,341,916 | 9/1967 | Greene | 29/25.11 |
| 3,379,915 | 4/1968 | Sentementes et al. | 313/108 |
| 3,395,058 | 7/1968 | Kennedy | 156/67 |
| 3,497,750 | 2/1970 | Knochel et al. | 313/108 |
| 4,035,686 | 7/1977 | Fleming | 313/503 |
| 4,104,555 | 8/1978 | Fleming | 313/512 |
| 4,238,793 | 12/1980 | Hochstrate | 340/781 |
| 4,502,917 | 3/1985 | Chamberlin | 427/66 X |
| 4,513,023 | 4/1985 | Wary | 427/66 X |
| 4,614,668 | 9/1986 | Topp et al. | 313/505 X |

OTHER PUBLICATIONS

"Recent Advances in Dichroioliquid Crystal Displays for Automotive Application", Imeck, E. 1981, pp. 331–336.

*Primary Examiner*—David K. Moore
*Assistant Examiner*—Sandra L. O'Shea
*Attorney, Agent, or Firm*—Ratner & Prestia

[57] ABSTRACT

An electroluminescent display is fabricated from an electroluminescent panel having an electroluminescent material coated on a substrate and a transparent conductor covering the electroluminescent material. The transparent conductor is masked according to the desired display format and unmasked areas of the transparent conductor are etched away. The masked areas and, therefore, each resulting region of layered electroluminescent material and transparent conductor, is composed of a unitary display segment and lead segment through which electricity is conducted to the display segment. A metallic conductor is applied to selected areas of the substrate on the surface opposite from the electroluminescent material and each region of metallic conductor is composed of a unitary display segment and lead segment through which electricity is conducted to the display segment.

11 Claims, 8 Drawing Figures

ELECTROLUMINESCENT DISPLAY AND METHOD OF MAKING SAME

TECHNICAL FIELD

The present invention relates, in general, to electroluminescent devices and, in particular, to (1) a method for applying the conductors and leads through which electricity is supplied to excite the electroluminescent material, and (2) the product made by this method.

BACKGROUND ART

In the past, electroluminescent displays were fabricated by carefully depositing electroluminescent material layers of prescribed thicknesses at designated locations on a substrate and selectively placing electrical conductors, which carry electricity to excite the electroluminescent material, on both sides of the electroluminescent material. These displays presented little risk to short-circuiting the electrical conductors when electrical leads, through which power is supplied, were mechanically fastened to their respective electrical conductors. The designer of the electroluminescent display had sufficient flexibility in shaping, sizing and positioning the electrical conductors and their associated electrical leads, so that they would not overlap at the connection points and create a short-circuit as connections were made and the connecting components might pierce through the display.

Recently, electroluminescent sheets and rolls have become available and have received widespread acceptance. Typically, electroluminescent sheets and rolls are relatively thin and are composed of a substrate coated with the electroluminescent material and a transparent conductor covering the electroluminescent material. Panels of desired size and shape are cut from the electroluminescent sheet or roll and then selectively coated with conductors, so that selected segments of the electroluminescent material are excited to produce the desired display when the conductors are energized.

It is apparent that producers of electroluminescent displays, when using electroluminescent sheets and rolls, are spared the problem of handling electroluminescent material and depositing this material over accurately defined areas in layers of prescribed thicknesses. They have a simpler task of selectively applying conductors to a panel cut from an electroluminescent sheet or roll to selectively energize the electroluminescent material.

However, connecting the electrical leads, through which power is supplied to the electroluminescent panel, to conductors disposed on opposite sides of the electroluminescent material can be a costly and time-consuming step in the fabrication of these electroluminescent displays. Care must be taken to assure that the components, such as copper clips, which press the electrical leads into good electrical contact with their respective conductors do not penetrate the relatively thin panel and short-circuit the conductors through these components. The risk of a short-circuit exists because the transparent conductor, which is part of the electroluminescent sheet or roll, extends across the entire face of the panel. A connecting component, applied to a conductor on the opposite side of the panel from the transparent conductor, will make contact with the transparent conductor if it penetrates through the panel.

DISCLOSURE OF THE INVENTION

An electroluminescent display is fabricated, according to the present invention, by providing an electroluminescent panel having an electroluminescent material on a first surface of a non-conducting substrate and a transparent conductor covering the electroluminescent material. A mask, resistant to etching solvent, is produced on the transparent conductor to cover selected areas of the transparent conductor and corresponding areas of the electroluminescent material lying beneath the masked areas of the transparent conductor. Each masked area is composed of a unitary display segment and lead segment. After applying an etching solvent to unmasked portions of the transparent conductor, unmasked portions of the transparent conductor are etched away resulting in selected regions of layered electroluminescent material and transparent conductor. Each such region is composed of a unitary display segment and lead segment. Next, a metallic conductor is applied to selected areas of a second surface of the substrate opposite from the first surface. Each selected region of metallic conductor is composed of a unitary display segment and lead segment. The etched electroluminescent panel, with the metallic conductor applied, then is enclosed within a non-conducting envelope having a transparent surface extending over the regions of layered electroluminescent material and transparent conductor. A first set of terminals is connected to the lead segments of the transparent conductor and a second set of terminals is connected to the lead segments of the metallic conductor.

BRIEF DESCRIPTION OF THE DRAWINGS

Referring to the drawings.

BEST MODE FOR CARRYING OUT THE INVENTION

Figure 1A:
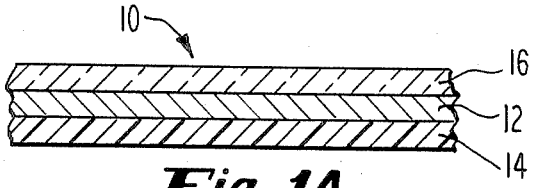
FIGS. 1A through 1E are sectional views which illustrate the sequence of steps for producing an electroluminescent display in accordance with the present invention.
Figure 1B:
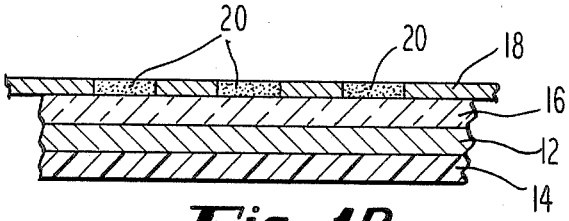

The drawings illustrate the fabrication of an electroluminescent dot-matrix display in accordance with the present invention. It will be apparent that other formats can be produced according to the present invention.

Referring to the drawings, an electroluminescent display, fabricated in accordance with the present invention, includes an electroluminescent panel 10 having an electroluminescent material 12 on a first surface **14*a* of a non-conducting substrate 14 and a transparent conductor 16 covering electroluminescent material 12**. An electroluminescent panel is cut to the desired shape and size from a relatively thin layered sheet or roll composed of the substrate, the electroluminescent material, and the transparent conductor. The electroluminescent coating can be any of a variety of phosphorescent materials, for example, copper activated or copper manganese activated zinc sulfide. The substrate can be a polyester such as mylar. Transparent conductor can be indium tin oxide.

Next, a mask, resistant to etching solvent, is produced covering selected areas of transparent conductor 16 and corresponding areas of electroluminescent material 12 lying beneath the masked areas of the transparent conductor. The masking of transparent conductor 16 corresponds to the desired display format which is to be produced.

The masking of transparent conductor 16 can be accomplished in a number of ways. One preferred method is to lay a stencil 18 on transparent conductor 16 and deposit a mask of transparent ultraviolet ink 20 on those portions of transparent conductor 16 exposed through openings in stencil 18 which correspond to the desired format of the display. The deposits of ultraviolet ink 20 are hardened by radiating the ultraviolet ink with an ultraviolet light. Ultraviolet ink 20 may be a clear acrylic base ultraviolet curable material.

Figure 1C:
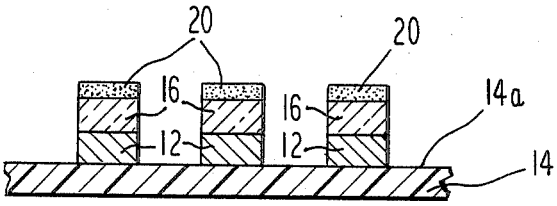
Figure 1D:
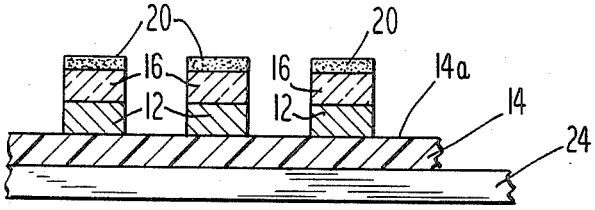
Figure 1E:
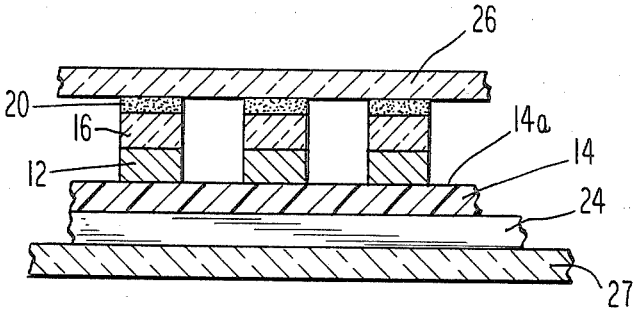

After stencil 18 is removed, an etching solvent such as methyl ethyl ketone is applied to the unmasked portions of transparent conductor 16 to etch away unmasked portions of the transparent conductor. As shown in FIG. 1C, this produces selected regions of layered electroluminescent material 12 and transparent conductor 16. It is not necessary to remove unmasked portions of electroluminescent material 12 because the unmasked portions of electroluminescent materials can not be energized after the transparent conductor is removed.

Figure 2:
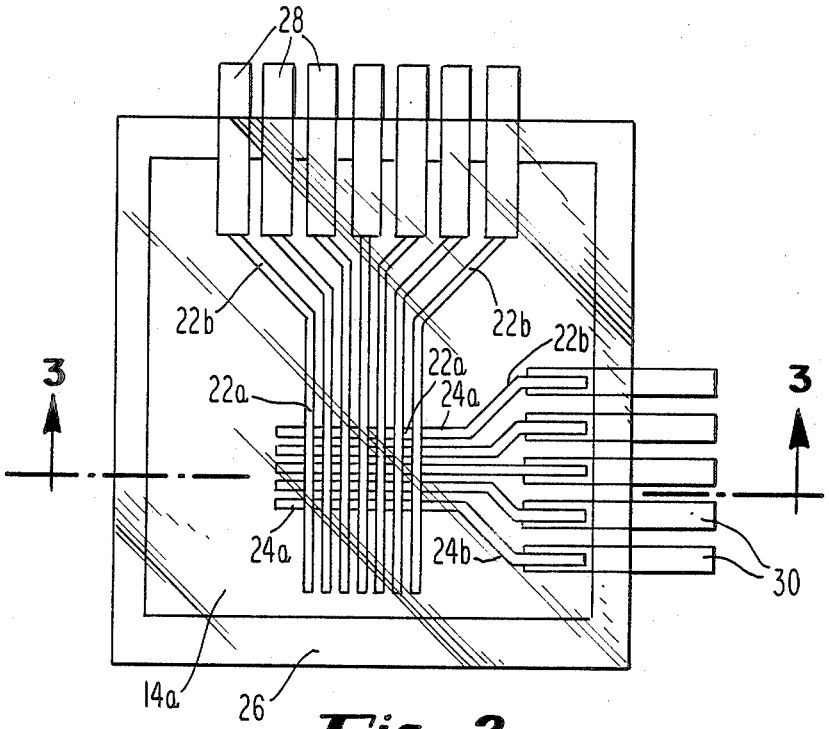
FIG. 2 is a top view of one electroluminescent display constructed in accordance with the present invention.
Figure 3:
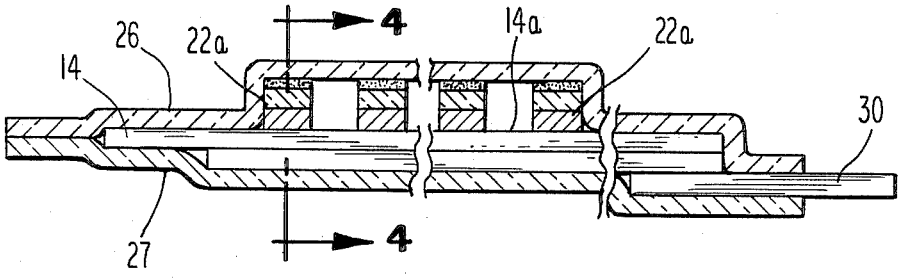
FIG. 3 is a sectional view taken along line 3—3 of FIG. 2.
Figure 4:
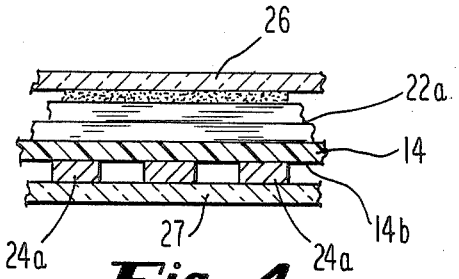
FIG. 4 is a sectional view taken along line 4–4 of FIG. 3.

As shown in FIG. 2, each discrete region of layered electroluminescent material and transparent conductor is composed of a unitary display segment **22*a* and lead segment 22*b*. Display segments 22*a* form a part of the desired electroluminescent display, while lead segments 22*b* serve to conduct electricity to the display segments. For the dot-matrix display shown in FIG. 2, each display segment 22*a* is a straight line of prescribed width spaced from an adajcent display segment 22*a*** by a prescribed distance.

Next, a metallic conductor 24 is applied to one or more selected areas of a second surface **14*b* of substrate 14 opposite from surface 14*a*. A selected region of metallic conductor is composed of a unitary display segment 24*a* and lead segment 24*b*. A display segment 24*a* forms part of the desired electroluminescent display, while a lead segment 24*b* serves to conduct electricity to the display segment. For the dot-matrix display shown in FIG. 2, in which a plurality of selected regions of metallic conductor are provided, each display segment 24*a* is a straight line of prescribed width spaced from an adjacent display segment 24*a* by a prescribed distance and disposed perpendicular to display segments 22*a*. The application of metallic conductor 24** can be done by conventional selective coating techniques, such as by a silk screen process, which involves masking the surface to be coated and applying a metal, such as silver, according to the mask.

The etched and coated electroluminescent panel then is enclosed within a non-conducting envelope having a transparent surface extending over regions of layered electroluminescent material and transparent conductor. This can be accomplished by placing a pair of transparent sheets 26 and 27 on opposite sides of the etched and coated panel with the edges of transparent sheets 26 and 27 extending beyond the edges of the panel and heat-sealing the edges. Then the envelope is trimmed to the desired size and shape as shown in FIG. 2.

A first set of terminals 28 is attached to lead segments **22*b* and a second set of terminals 30 is connected to lead segments 24*b*. These terminals can be connected to the associated lead segments either before the application of transparent sheets 26 and 27** or afterwards by penetrating the transparent sheets.

When electricity is applied to selected ones of terminals 28 and 30, the electroluminescent material between the intersections of the display segments associated with the selected terminals is excited. Electroluminescent material beneath lead segments **22*b* or above lead segments 24*b* is not excited because there is no metallic conductor or transparent conductor on the opposite side of the electroluminescent material. Lead segments 22*b* of the transparent conductor lie outside the area defined by the outermost portions of display segments 24*a* of the metallic conductor and lead segments 24*b* of the metallic conductor lie outside the area defined by the outermost portions of the display segments 22*a*** of the transparent conductor.

The ultraviolet ink, being transparent, need not be removed from the areas over which it is deposited. However, if other masking material is used which is opaque, it must be removed after the etching step.

The foregoing has set forth an exemplary and preferred embodiment of the present invention. It will be understood, however, that various alternatives will occur to those of ordinary skill in the art without departure from the spirit and scope of the present invention.

What is claimed is:

1. A method for making an electroluminescent display comprising the steps of:

providing an electroluminescent panel having an electroluminescent material on a first surface of a non-conducting substrate and a transparent conductor covering said electroluminescent material;

producing on said transparent conductor an ultraviolet ink mask resistant to etching solvent, radiating said ultraviolet ink with ultraviolet light to cure said ultraviolet ink;

covering selected areas of said transparent conductor and corresponding areas of said electroluminescent material lying beneath masked areas of said transparent conductor, each masked area comprised of a unitary display segment and lead segment;

applying an etching solvent to unmasked portions of said transparent conductor to etch away unmasked portions of said transparent conductor and unmasked portions of said electroluminescent material and to produce selected regions of layered electroluminescent material and transparent conductor each comprised of a unitary display segment and lead segment;

applying a metallic conductor to selected areas of a second surface of said substrate opposite from said first surface, each selected region of metallic conductor comprised of a unitary display segment and lead segment;

enclosing the etched electroluminescent panel with said metallic conductor applied within a non-conducting envelope having a transparent surface extending over said regions of layered electroluminescent material and transparent conductor;

and attaching a first set of terminals to said lead segments of said transparent conductor and a second set of terminals to said lead segments of said metallic conductor.

2. A method according to claim 1 wherein said mask is produced by:

(a) placing on said transparent conductor a stencil having openings corresponding to said mask; and
(b) depositing a mask material onto said transparent conductor exposed through said openings in said stencil.

3. A method according to claim 2 wherein said mask material is transparent and said mask material remains with the finished article.

4. A method according to claim 3 wherein said metallic conductor is applied by coating said conductor on said second surface of said substrate.

5. A method according to claim 4 wherein said metallic conductor is coated on said second surface of said substrate by:
(a) masking said second surface, and
(b) applying a metal coating to selected areas of said second surface in accordance with said masking.

6. An electroluminescent display comprising:
a non-conducting substrate;
a layer of electroluminescent material covering a defined area of a first surface of said substrate and comprised of a unitary display segment and lead segment;
a transparent conductor covering said electroluminescent material and comprised of a unitary display segment and a lead segment;
a mask of transparent, cured ink covering said electroluminescent material and said transparent conductor;
a metallic conductor covering a defined area of a second surface of said substrate opposite from said first surface and comprised of a unitary display segment and lead segment;
a non-conducting envelope enclosing said substrate, said electroluminescent material, said transparent conductor, said transparent ink and said metallic conductor and having a transparent surface extending over said transparent conductor;
and first and second terminals attached, respectively, to said lead segment of said transparent conductor and said lead segment of said metallic conductor.

7. An electroluminescent display according to claim 6 wherein said lead segment of said transparent conductor is outside the area defined by the outermost portions of said display segment of said metallic conductor and said lead segment of said metallic conductor is outside the area defined by the outermost portions of said display segment of said transparent conductor.

8. An electroluminescent display according to claim 7 wherein said metallic conductor is silver.

9. An electroluminescent display comprising:
a non-conducting substrate;
an electroluminescent material covering a plurality of discrete areas of a first surface of said substrate, each discrete region of electroluminescent material comprised of a unitary display segment and lead segment;
a transparent conductor covering each discrete region of electroluminescent material and comprised of a unitary display segment and lead segment;
a mask of transparent cured ink covering each transparent conductor and discrete region of electroluminescent material and comprised of a unitary display segment and lead segment;
a metallic conductor covering a plurality of discrete areas of a second surface of said substrate opposite from said first surface, each discrete region of metallic conductor comprised of a unitary display segment and lead segment;
a non-conducting envelope enclosing said substrate, said discrete regions of electroluminescent material, said discrete regions of transparent conductor and said discrete regions of metallic conductor and having a transparent surface extending over said discrete regions of transparent conductor;
and first and second sets of terminals attached, respectively, to said lead segments of said transparent conductor and said lead segments of said metallic conductor.

10. An electroluminescent display according to claim 9 wherein:
(a) each of said unitary display segments of said electroluminescent material and said transparent conductor is a straight line of prescribed width spaced from an adjacent display segment by a prescribed distance; and
(b) a first display segment of said metallic conductor is a straight line of prescribed width spaced from a second adjacent display segment by a prescribed distance and disposed perpendicular to said display segments of said electroluminescent material and said transparent conductor.

11. An electroluminescent display according to claim 10 wherein said lead segments of said transparent conductor are outside the area defined by the outermost display segments of said metallic conductor and said lead segments of said metallic conductor are outside the area defined by the outermost display segments of said transparent conductor.

* * * * *